US005181606A

United States Patent [19]

Martell

[11] Patent Number: 5,181,606

[45] Date of Patent: Jan. 26, 1993

[54] SOAP DISH

[76] Inventor: Steve Martell, 12201 S. Oglesby, Chicago, Ill. 60633

[21] Appl. No.: 813,475

[22] Filed: Dec. 26, 1991

[51] Int. Cl.[5] ..... A47K 5/04

[52] U.S. Cl. ..... 206/77.1; D6/536

[58] Field of Search ..... 206/77.1, 564, 581, 206/823; D6/532, 536-540

[56] References Cited

U.S. PATENT DOCUMENTS

| | | | |
|---|---|---|---|
| D. 147,515 | 9/1947 | Treiber | D6/536 |
| D. 151,211 | 10/1948 | Bradbury | D6/540 |
| D. 154,646 | 7/1949 | Travis | D6/536 |
| D. 165,532 | 12/1951 | Lind . | |
| D. 188,453 | 7/1960 | Marcus | D6/532 |
| D. 266,123 | 9/1982 | Alfano . | |
| D. 283,282 | 4/1986 | Haske . | |
| D. 286,237 | 10/1986 | Muderlak . | |
| D. 288,510 | 3/1987 | Shames et al. . | |
| 1,536,906 | 5/1925 | Miller . | |
| 2,067,591 | 1/1937 | Balmer . | |
| 3,233,744 | 2/1966 | Ripps . | |
| 3,323,850 | 6/1967 | Link . | |
| 4,277,042 | 7/1981 | Ash, Sr. | D6/537 |
| 4,300,248 | 11/1981 | Dworkin . | |
| 4,331,232 | 5/1982 | Larkin | 206/77.1 |
| 4,548,340 | 10/1985 | Messer . | |
| 4,621,730 | 11/1986 | Mancusi, Jr. | 206/77.1 |
| 4,709,428 | 12/1987 | Garcia . | |
| 4,993,546 | 2/1991 | Southard | 206/77.1 |

FOREIGN PATENT DOCUMENTS

| | | | |
|---|---|---|---|
| 2604885 | 4/1988 | France | D6/532 |
| 2060374 | 5/1981 | United Kingdom | 206/77.1 |

*Primary Examiner*—Jimmy G. Foster

*Attorney, Agent, or Firm*—McAndrews, Held & Malloy, Ltd.

[57] ABSTRACT

A soap dish is made of ribs that are shaped to allow a user to pick up a bar of soap in a single grasp without lifting the soap over a rim or lip. The soap dish is also shaped to hold the soap in a stable and stationary position when the user puts the soap in the dish and to permit adequate drainage of water and soap residue. The ribs form the support surface for the soap, so that the soap rests on the top edges of the ribs. Each of the ribs has a portion that slopes up to form with the other ribs a valley that keeps the soap in the dish. The soap dish has a weighted base to increase its stability and a trough to direct water and soap residue away from the soap dish. The dimensions and arrangement of the soap dish are particularly appropriate for maximum ease of manufacture by injection molding of an acrylic material in a minimum number of separate components.

4 Claims, 2 Drawing Sheets

SOAP DISH

BACKGROUND OF THE INVENTION

This invention is related to soap dishes. In particular, it is an improved standing soap dish that supports a bar of soap so that the bar can be picked up easily with a simple grasp and a pull. The soap dish also catches any dripping water or soap residues and directs them away from the standing soap dish.

It is convenient in a lavatory or the like to provide a soap dish that holds a bar of soap ready for use and that permits water and soap residues to drain from the bar of soap to a convenient location after use so the bar does not sit in water and soften. Many soap dishes are available to hold soap bars. An example is taught in design patent U.S. Pat. No. Des. 293,638, entitled "Soap Dish." The soap dish of the '638 patent holds a bar of soap and lets it drain. However, this soap dish has the disadvantages of collecting dripping water and soap residues in the soap dish, and the soap dish also includes a lip which makes it more difficult to remove a bar for use.

U.S. Pat. No. Des. 293,751, entitled "Soap Storage Dish," is a free-standing soap dish which holds a bar of soap at an angle that makes it easier to remove the soap than was the case with the '638 patent. However, the soap dish of the '751 patent also collects drained water and soap residues in the soap dish, which must be emptied periodically. This is a disadvantage in comparison with a soap dish that drains freely.

U.S. Pat. No. Des. 278,491, entitled "Soap Holder," is a soap dish that holds a bar of soap on a flat surface that has slits. Removal of the soap from the soap dish of the '491 patent is unimpeded by a lip and should therefore be relatively easy if the soap does not stick to the flat surface. As with the soap dishes of the two design patents mentioned above, however, water and soap residues in the '491 patent drain into the bottom of the soap dish which must be cleaned periodically.

U.S. Pat. No. Des. 203,331, entitled "Soap Holder," teaches a soap dish that supports a bar of soap on ribs that are at an angle to the perpendicular. The soap dish of the '331 patent has a minimal lip to interfere with removal of a bar of soap from the soap dish. However, water and soap residues in the soap dish of the '331 patent accumulate at the bottom of the soap dish and must be removed from it periodically.

It is an object of the present invention to provide a soap dish shaped to make it easy to remove soap for use.

It is another object of the present invention to provide a soap dish that holds soap securely.

It is another object of the present invention to provide a soap dish that permits adequate drainage so as to prevent the accumulation of soap residues below the bar of soap.

It is another object of the present invention to provide a standing soap dish that is both movable and stable.

Other objects will become apparent in the course of a detailed description of the invention.

SUMMARY OF THE INVENTION

A soap dish is shaped to allow a user to pick up a bar of soap in a single grasping motion without lifting the soap over a rim or lip. The soap dish is also shaped to hold the soap in a stable, stationary position when the user replaces the soap, and to permit adequate drainage of water and soap residue. The soap dish includes a plurality of sloped ribs that forms the support surface for the soap, so that the soap rests on the top edges of the ribs. Each of the sloped ribs has a portion that slopes up to form with the other ribs a valley that keeps the soap in the dish. The soap dish has a weighted base to increase its stability and a trough to direct water and soap residue away from the soap dish. The dimensions and arrangement of the soap dish are particularly appropriate for maximum ease of manufacture by injection molding of an acrylic material in a minimum number of separate components.

DETAILED DESCRIPTION OF THE INVENTION

Figure 1:
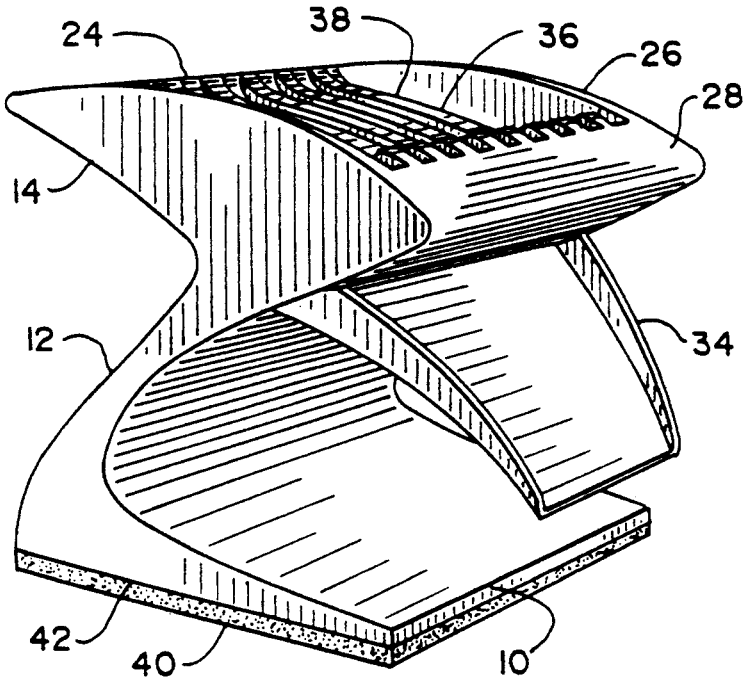
FIG. 1 is a perspective view of the soap dish of the present invention.
Figure 2:
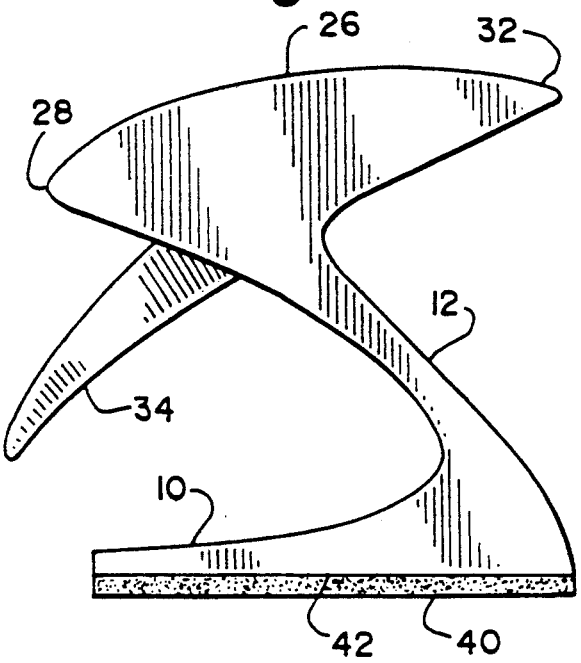
FIG. 2 is a side view of the soap dish of FIG. 1.
Figure 3:
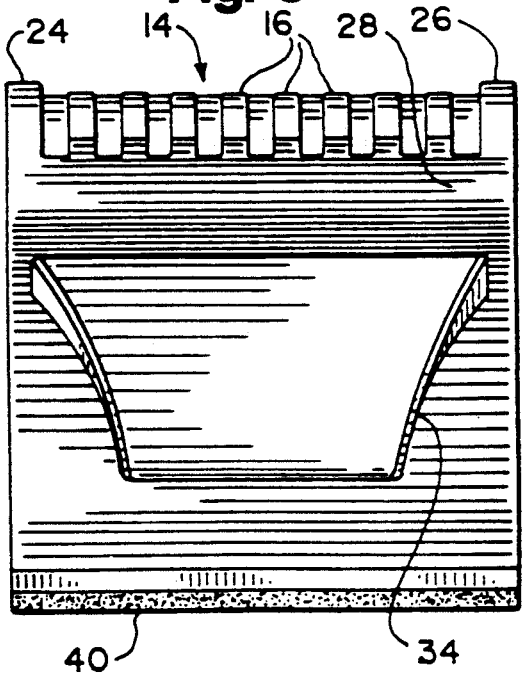
FIG. 3 is a front view of the soap dish of FIG. 1.
Figure 4:
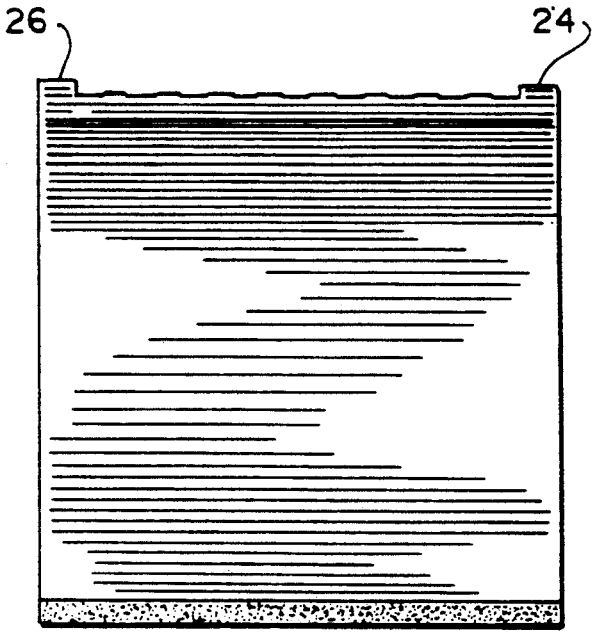
FIG. 4 is a top view of the soap dish of FIG. 1.
Figure 5:
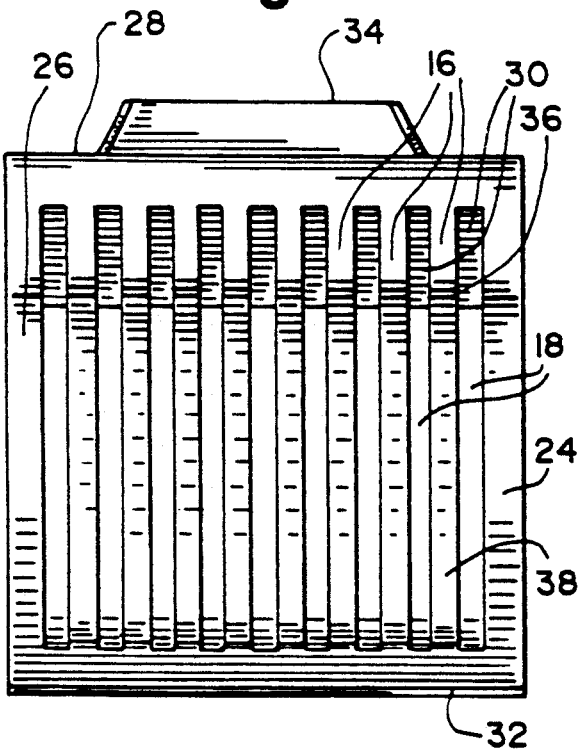
FIG. 5 is a top view of the soap dish of the invention.
Figure 6:
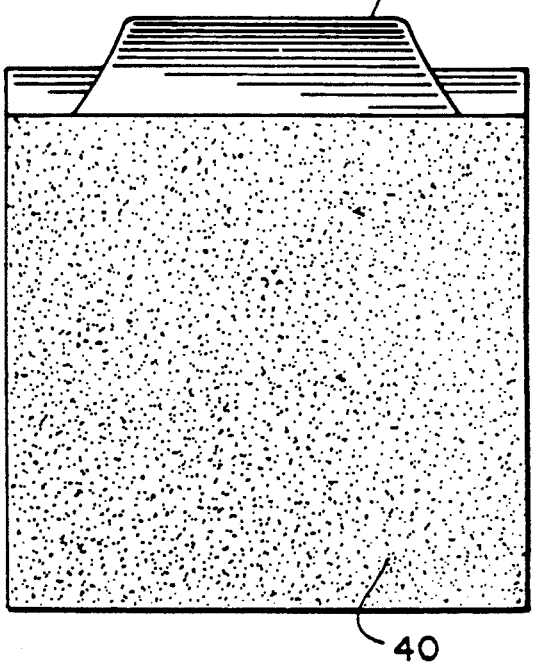
FIG. 6 is a bottom view of the soap dish of the invention.

FIG. 1 is a perspective view of the soap dish of the present invention; FIG. 2 is a side view of the soap dish of FIG. 1; FIG. 3 is a front view of the soap dish of FIG. 1; and FIG. 4 is a top view of the soap dish of FIG. 1. In FIGS. 1–4, a base 10 supports a web 12, which in turn supports a soap rack 14. The soap rack 14 comprises a plurality of substantially parallel ribs 16 that are separated by slots 18 that allow drainage of water and soap scum from a wet bar of soap after it has been used. FIG. 1 shows eight ribs 16 and suggests that the ribs 16 are about equal in thickness to the width of the slots 18. This is a preferred arrangement of ribs 16 and slots 18, but it should be evident that this is a matter of design choice. The number of ribs 16 could be larger or smaller, and the spacing of the ribs could be varied by making the slots 18 narrower or wider than the thickness of the ribs 16. This is a matter of design choice.

The soap rack 14 is bounded by a first end piece 24 and a second end piece 26 which are raised to keep a bar of soap in the soap rack 14. The end pieces 24 and 26 are substantially parallel and are separated by a distance that is greater than the length of a typical bar of bath soap, which is about 4¼ inches or about 11 centimeters. Each of the ribs 16 is attached at the front to a bar 28 that also forms a bottom 30 for a portion of each of the slots 18. The bottom 30 is attached to the end pieces 24 and 26, which in turn are attached to the web 12. The ribs 16 are attached at the rear to a plate 32, which forms a portion of the bottom of the slots 18 and channels any runoff of water and soap residues to a trough 34. In the preferred embodiment of the invention, the trough 34 extends beyond the base 10 so that the runoff does not drip on the base 10.

Each of the ribs 16 has a front portion 36 and a rear portion 38. The rear portions 38 of all of the ribs 16 are longer than the front portions 36 to provide the main ,support for a bar of soap in the soap dish. The front portions 36 keep the soap bar in place while allowing a user to grab the soap and remove it without lifting it over a lip or rim.

It is preferable that the standing soap dish not scratch a surface upon which it rests and that it be relatively stable. The first of these objectives is attained by attaching a pad 40 of neoprene, rubber, or the like to the base 10. In the alternative, the bottom of the soap dish could be made of a plastic that does not scratch. The second objective is attained by weighting the soap dish as by a weight 42. In the preferred embodiment the weight 42 is molded into the soap dish so that it is hidden in use. It is also possible to insert a metal plate in or under the base; this is not shown. The soap dish of the present invention may be made of die-cast acrylic plastic, other thermosetting plastics, aluminum, brass, or the like. If the soap dish is made of aluminum, it may be anodized both for a better appearance and also to provide a protective coating that will prevent metal marks from being left on a sink or counter top. If the soap dish is made of brass, it will need to be chrome-plated or given a similar protective coating for a better appearance and also to prevent corrosion. In any of these cases, it is preferable to have the trough 34 made separately from the rest of the soap dish to simplify molding or die-casting. In the preferred embodiment, the soap dish is made of an acrylic plastic, the pad 40 is sheet neoprene or rubber, and the weight 42 is steel. The acrylic plastic may be clear or it may be rendered opaque by fillers of chosen colors. In either case it is possible to achieve an attractive shiny finish by die casting all but the trough 34 in one piece, after which the trough 34 is attached thermally by a heat gun or the like. If the dish is made of die-cast aluminum, the trough 34 that is also connected to the plate 32 may be bonded to the remaining structure by an adhesive. If the soap dish is made of brass, it is preferable to braze of silver solder the trough 34 in place before the soap dish is chrome plated or otherwise coated.

The description of the invention given above is intended to enable the practice of the invention by persons of ordinary skill in the art, and to disclose the best mode known to the inventor for the practice of the invention. The scope of the invention should be limited only by the attached claims and their equivalents.

I claim:

1. A standing soap dish comprising:

a. a plurality of substantially parallel ribs, each of the plurality of ribs having a rear portion and a front portion, each of the rear portions longer than the front portions and elevated to support a bar of soap, each of the front portions connected to one of the rear portions and elevated to keep the bar of soap in the soap dish;

b. a bar attached to each of the plurality of ribs at the front portion;

c. a plate attached to each of the plurality of ribs at the rear portion;

d. a pair of end pieces, each disposed substantially parallel to the ribs and at opposite sides of the ribs, the end pieces raised to keep the bar of soap from falling off the ribs at an end;

e. a web connected to the end pieces;

f. a base connected to the web; and g. a trough connected to the plate to catch runoff and direct the runoff to a location beyond the base.

2. The soap rack of claim 1 comprising in addition a weight connected to the base to provide stability to the soap rack.

3. The soap rack of claim 2 wherein the weight is molded into the base.

4. The soap rack of claim 3 wherein the ribs, end pieces, bar, plate, web, and base are molded in a unit of an acrylic material and wherein the trough is molded separately of an acrylic material and attached to complete the soap rack.

* * * * *